United States Patent [19]

Durand

[11] Patent Number: 5,072,483

[45] Date of Patent: Dec. 17, 1991

[54] ERASER

[76] Inventor: Roger Durand, #10 Antler Lake, 52343 Range Road, Sherwood Park, Alberta, Canada, T8G 1A6

[21] Appl. No.: 400,724

[22] Filed: Aug. 30, 1989

[30] Foreign Application Priority Data

Feb. 27, 1989 [CA] Canada ..... 592239

[51] Int. Cl.[5] ..... B43L 19/00

[52] U.S. Cl. ..... 15/210 R; 15/105.51; 15/426; 15/427; 248/205.2; 248/451

[58] Field of Search ..... 15/208, 210 R, 209 R, 15/268, 425–428, 105.51; 401/123, 130; 2/DIG. 6; 224/901; 248/450, 451, 205.2

[56] References Cited

U.S. PATENT DOCUMENTS

| | | | |
|---|---|---|---|
| 134,215 | 12/1872 | Morse | 15/427 |
| 423,238 | 3/1890 | Fowler | 15/427 |
| 536,935 | 4/1895 | McIntyre | 15/427 |
| 734,769 | 7/1903 | Stanley | 15/210 R |
| 948,822 | 2/1910 | McSweeney | 15/428 |
| 1,550,770 | 8/1925 | Akira | 15/428 |
| 3,089,182 | 5/1963 | Wofgren | 15/563 |
| 4,274,567 | 6/1981 | Sawyer | 224/42.43 |
| 4,403,761 | 9/1983 | Jamar | 248/447.1 |
| 4,543,680 | 10/1985 | Vlahos | 15/209 R X |
| 4,757,901 | 7/1988 | Woods | 206/575 |
| 4,852,221 | 8/1989 | Antonucci | 24/10 R |

FOREIGN PATENT DOCUMENTS

| | | | |
|---|---|---|---|
| 1337623 | 8/1963 | France | 15/428 |
| 2498355 | 7/1982 | France . | |
| 2557606 | 6/1985 | France . | |
| 0332969 | 12/1935 | Italy | 15/428 |
| 579996 | 9/1975 | Switzerland . | |
| 2148197A | 5/1985 | United Kingdom . | |

OTHER PUBLICATIONS

Specialized Velcro Brand Fastening Products, Velcro Corp., 9/72.

*Primary Examiner*—Henry J. Recla
*Assistant Examiner*—Casey Jacyna
*Attorney, Agent, or Firm*—Davis, Bujold & Streck

[57] ABSTRACT

An eraser consisting of a body having an aperture. A cloth covering is mounted to a portion of the body. When a writing instrument is inserted in the aperture the writing instrument provides a handle by which the body may be manipulated.

1 Claim, 7 Drawing Sheets

ERASER

The present invention relates to an eraser for white board.

BACKGROUND OF THE INVENTION

A writing surface commonly known as white board is becoming popular and is to a significant extent replacing the traditional blackboard. One rapidly expanding market is for miniature whiteboards. These whiteboards are taken by salespersons and the like for demonstrations at locations remote from the office. They are also ideally suited for use as scoreboards in games rooms. In order to use these white boards the user must have with the whiteboard a writing instrument with erasable ink, and an eraser. The erasers presently used are cloth covered; usually felt mounted on a backing block. When these erasers are reduced in size they are difficult to manipulate and easily become separated from the rest of the equipment required by the user.

SUMMARY OF THE INVENTION

What is required is an eraser which can be readily be manipulated in miniature and can readily be kept with the rest of the equipment required by the user.

According to the present invention there is provided an eraser consisting of a body having an aperture. A cloth covering is mounted to a portion of the body. When a writing instrument is inserted in the aperture the writing instrument provides a handle by which the body may be manipulated.

Writing instruments are sold with caps which are intended to retard evaporation of the ink and guard against unintentional marking of surrounding surfaces. By discarding this cap and replacing it with the eraser as described all the equipment needed by the user of the whiteboard is in one instrument.

Although beneficial results may be obtained through the use of the eraser as described, the functioning of the eraser is enhanced if the size of the contact area between the cloth covering and the whiteboard is increased. Even more beneficial results may therefore be obtained if the body has a planar surface on which the cloth covering is mounted.

Although beneficial results may be obtained through the use of the eraser as described, writing instruments used for writing on whiteboard come in a number of standard sizes. Even more beneficial results may therefore be obtained if the eraser has a plurality of apertures to accommodate differing sizes of writing instruments.

Although beneficial results may be obtained through the use of the eraser as described, a variety of cloth coverings are functional to serve to erase writing on a whiteboard. One type of cloth covering which is suitable is uncut nylon pile which is the type of fabric used for one component of mating tape fasteners. This uncut nylon pile will adhere to a strip of hook-like nylon pile fabric if such a strip were attached to a whiteboard, and provide a means of securing the writing instrument to the whiteboard. Even more beneficial results may therefore be obtained if the cloth covering is of uncut nylon pile.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 3:
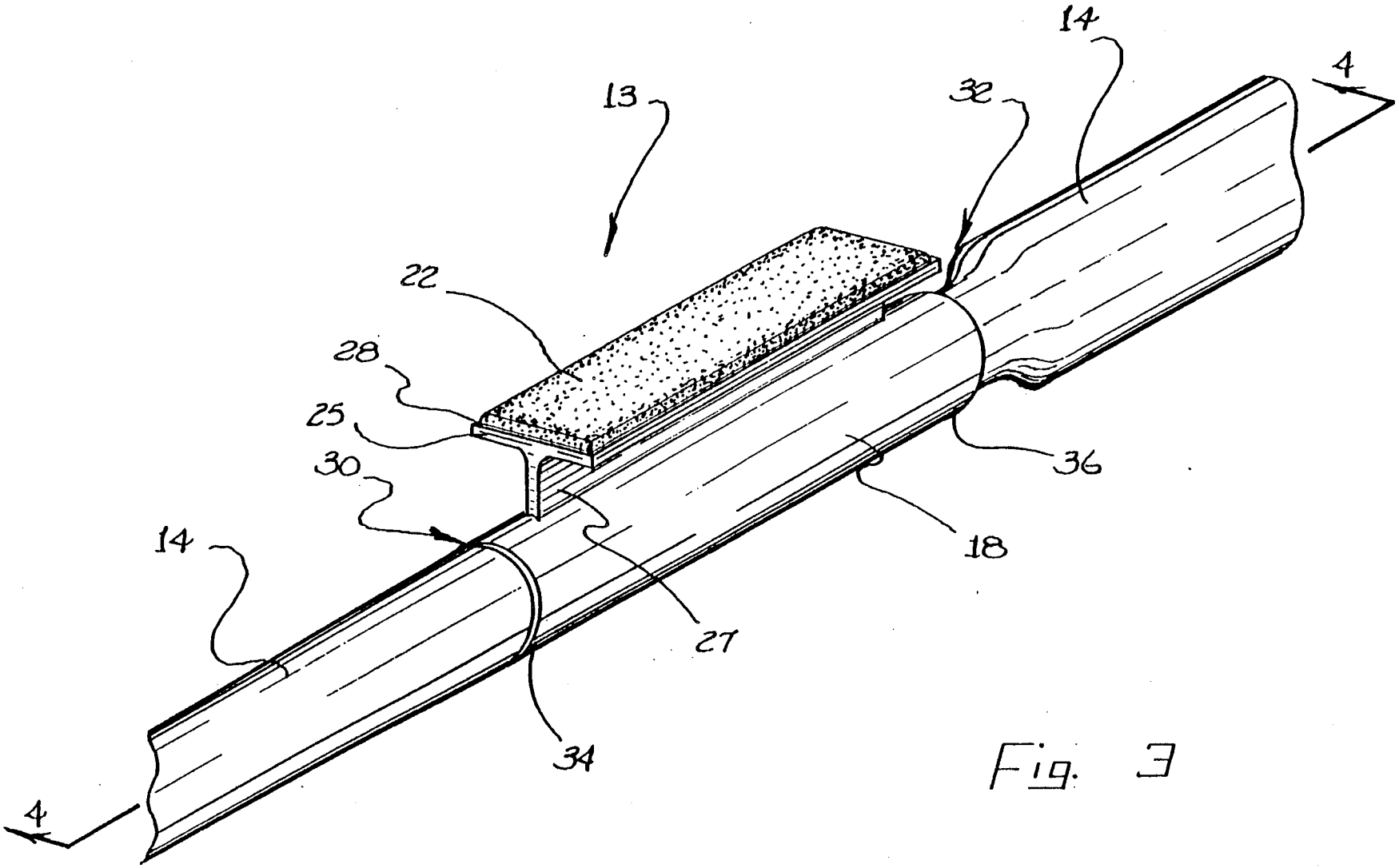
FIG. 3 is a perspective view of a third preferred embodiment of the invention.
Figure 4:
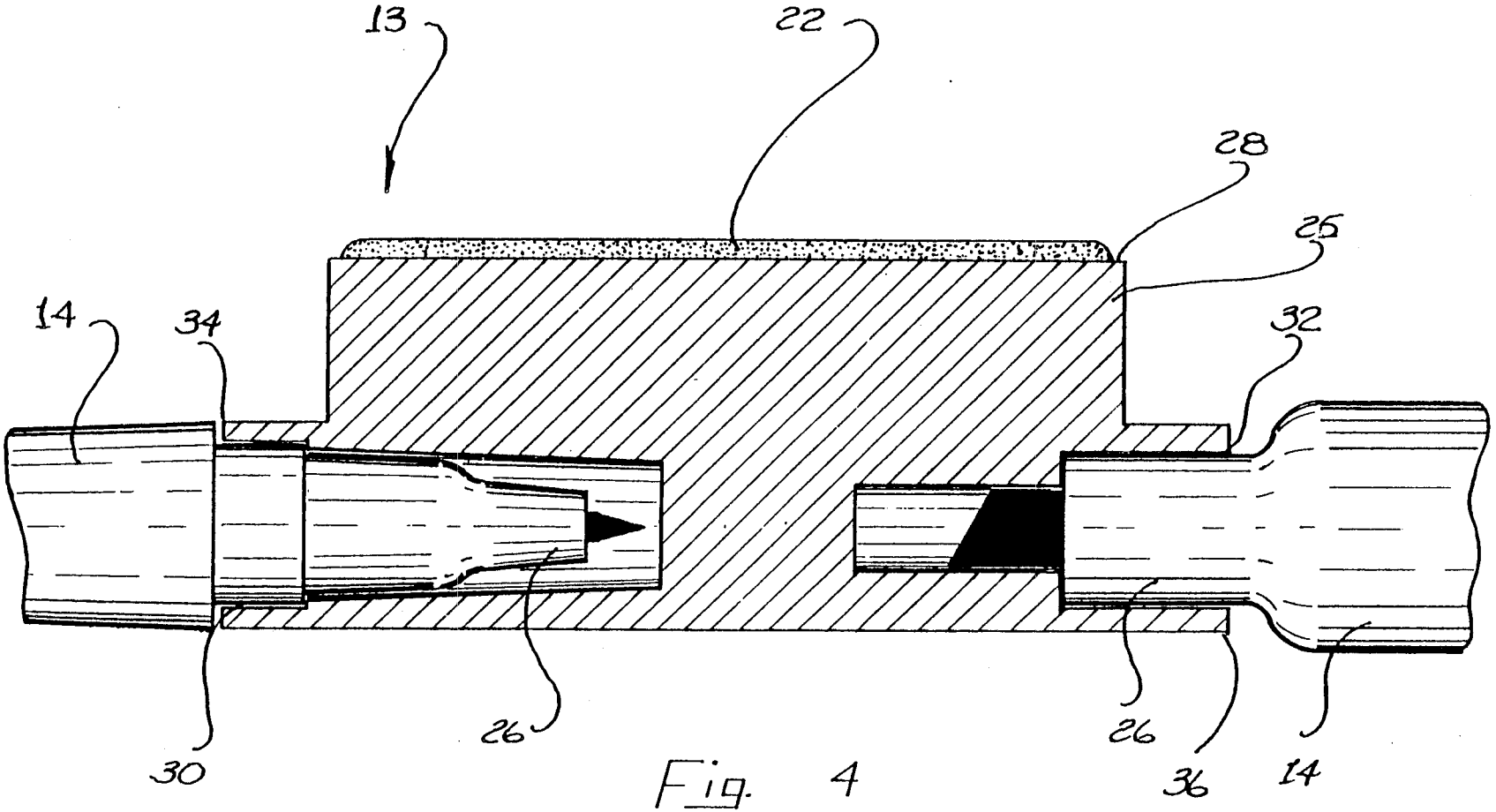
FIG. 4 is a section view taken along section lines 4—4 of FIG. 3.
Figure 5:
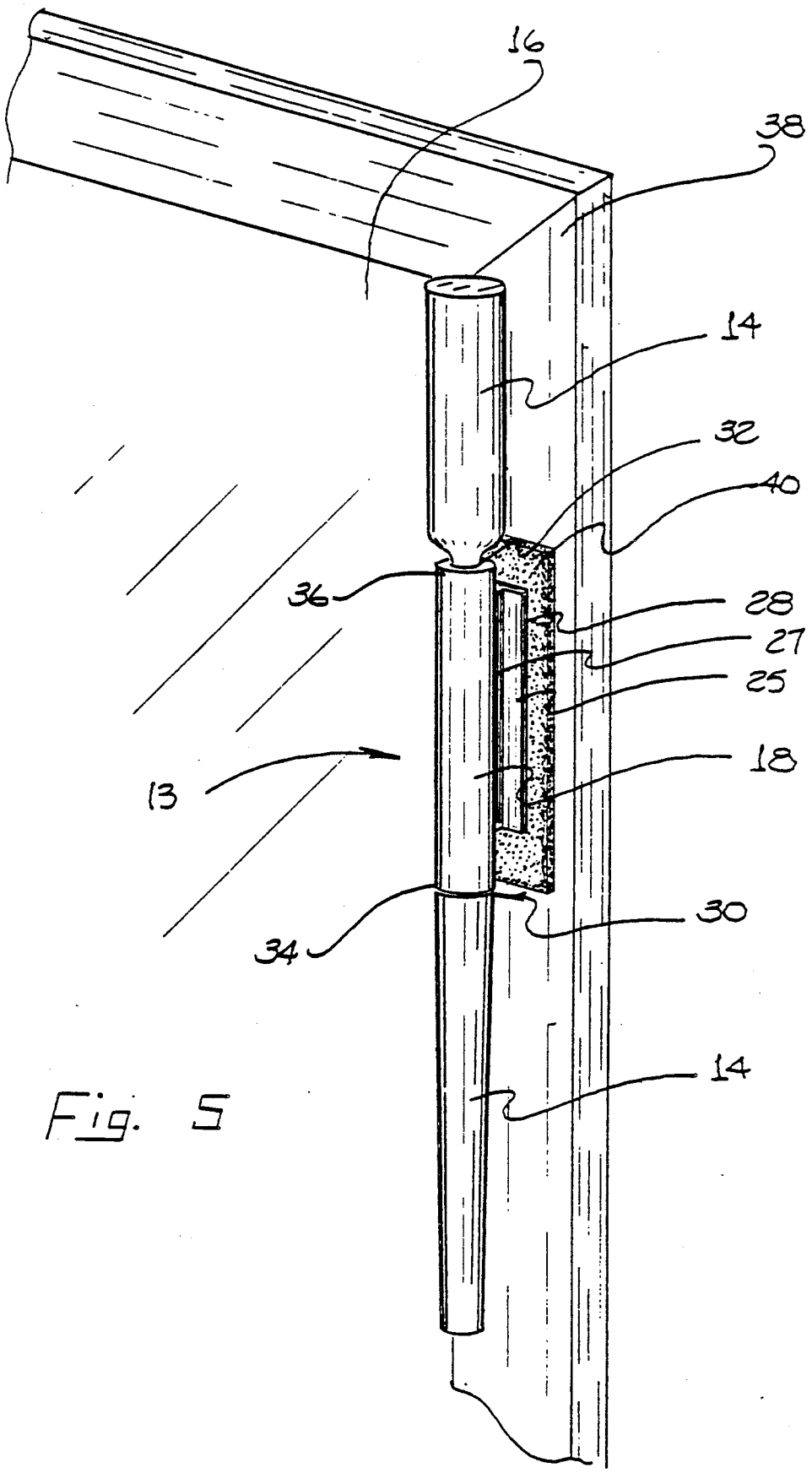
FIG. 5 is a perspective view of a combination of a writing instrument, a whiteboard, and the third preferred embodiment.
Figure 6:
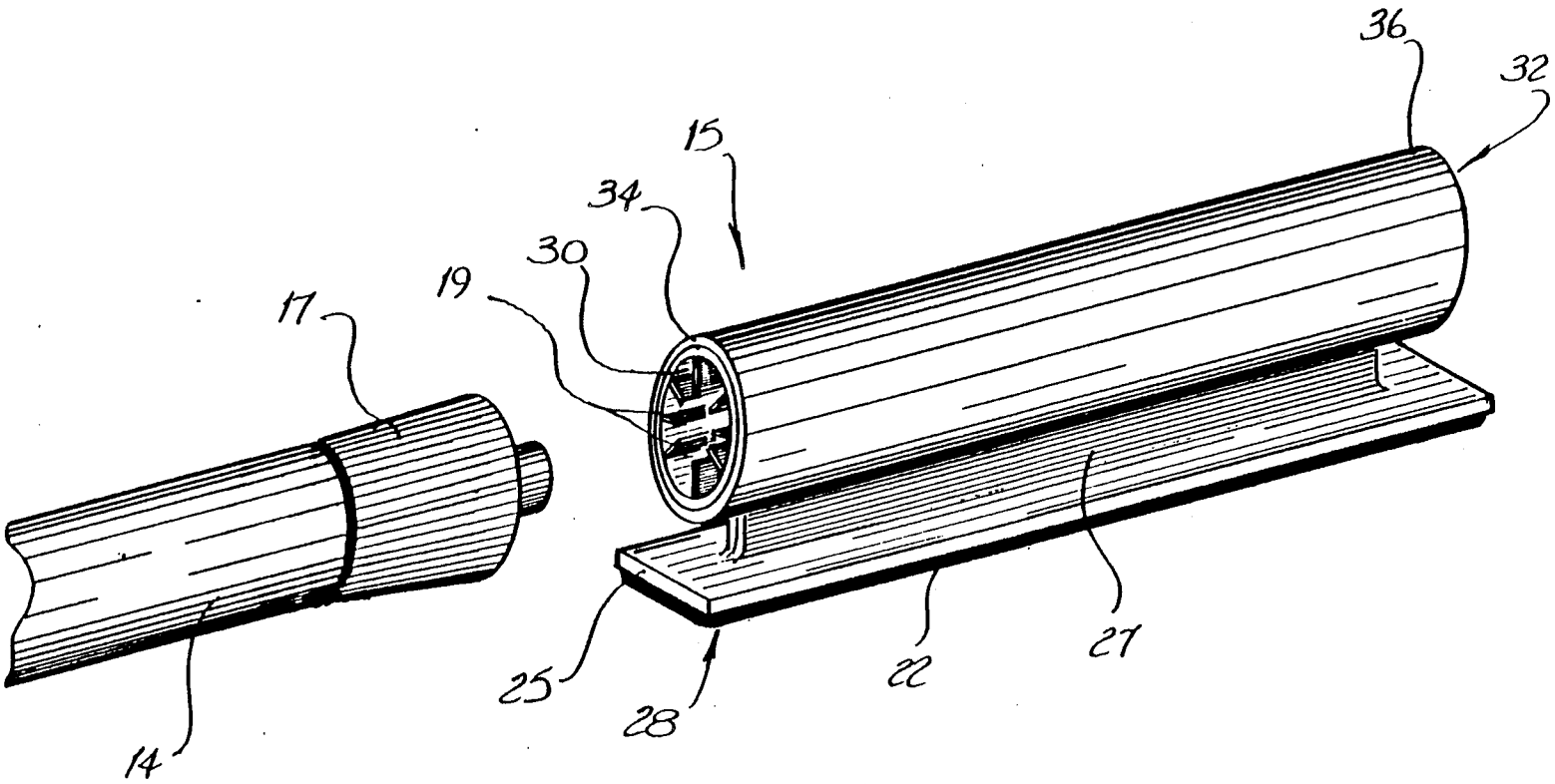
FIG. 6 is a perspective view of a fourth preferred embodiment of the invention.
Figure 7:
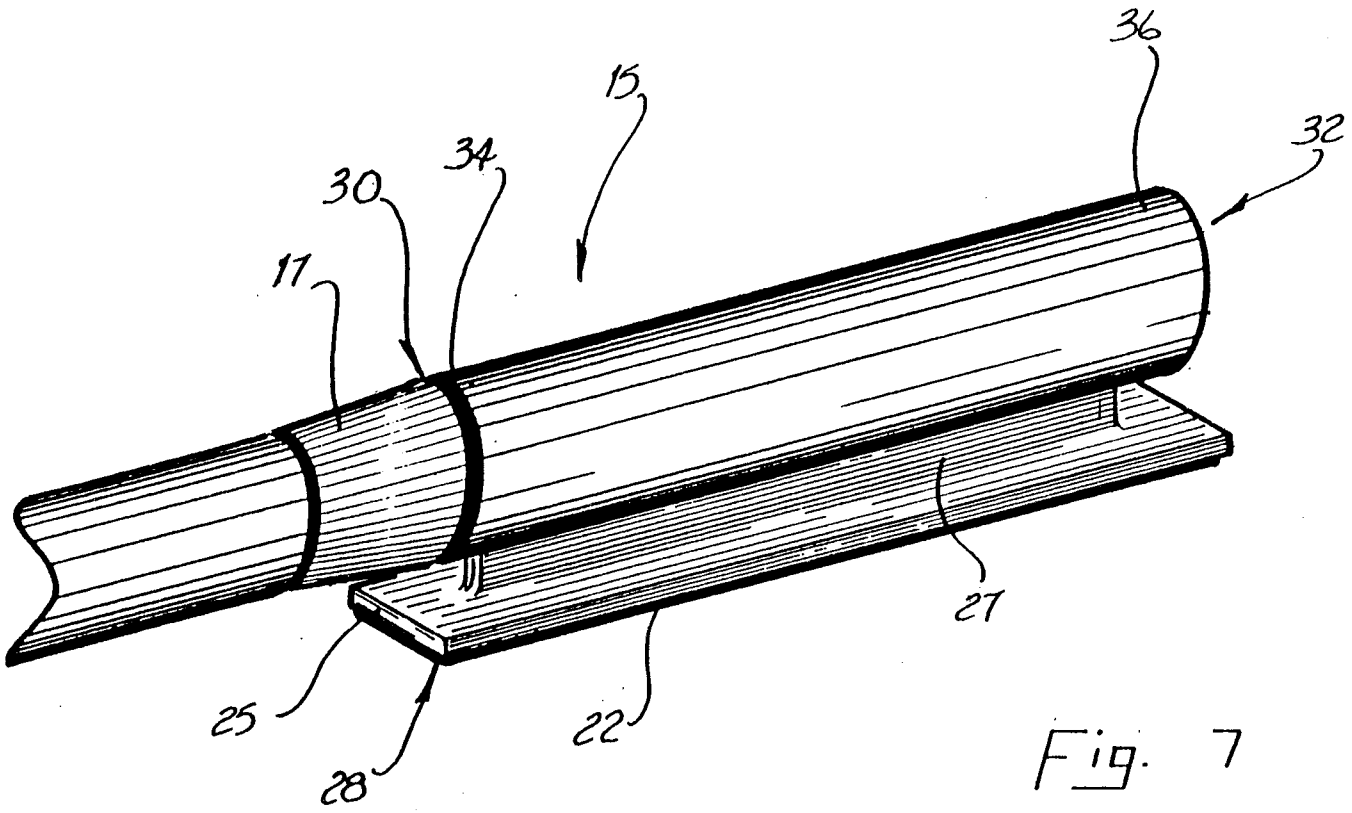
FIG. 7 is a perspective view of a fourth preferred embodiment of the invention.

The preferred embodiments will now be described with reference to FIGS. 1 through 7. A first preferred embodiment, generally designated by reference numeral 10, is an eraser illustrated in FIG. 1. First preferred embodiment 10 shows the inventive concept in its most rudimentary form. A second preferred embodiment, generally designated by reference numeral 12, is an eraser illustrated in FIG. 2. Second preferred embodiment 12 is closer to a commercial embodiment of the inventive concept. A third preferred embodiment, generally designated by reference numeral 13, is an eraser as illustrated in FIGS. 3 and 4. Preferred embodiments 10 and 12 can only be manipulated when coupled with a writing instrument 14. Preferred embodiment 13 is capable of use independently of writing instrument 14. All of preferred embodiments 10, 12, and 13 cooperate with a whiteboard 16, as illustrated in FIG. 5. A fourth embodiment, generally designated by reference numeral 15, is an eraser as illustrated in FIGS. 6 and 7. This embodiment is an alternative approach where the cap of a writing instrument is secured to eraser 15.

Figure 1:
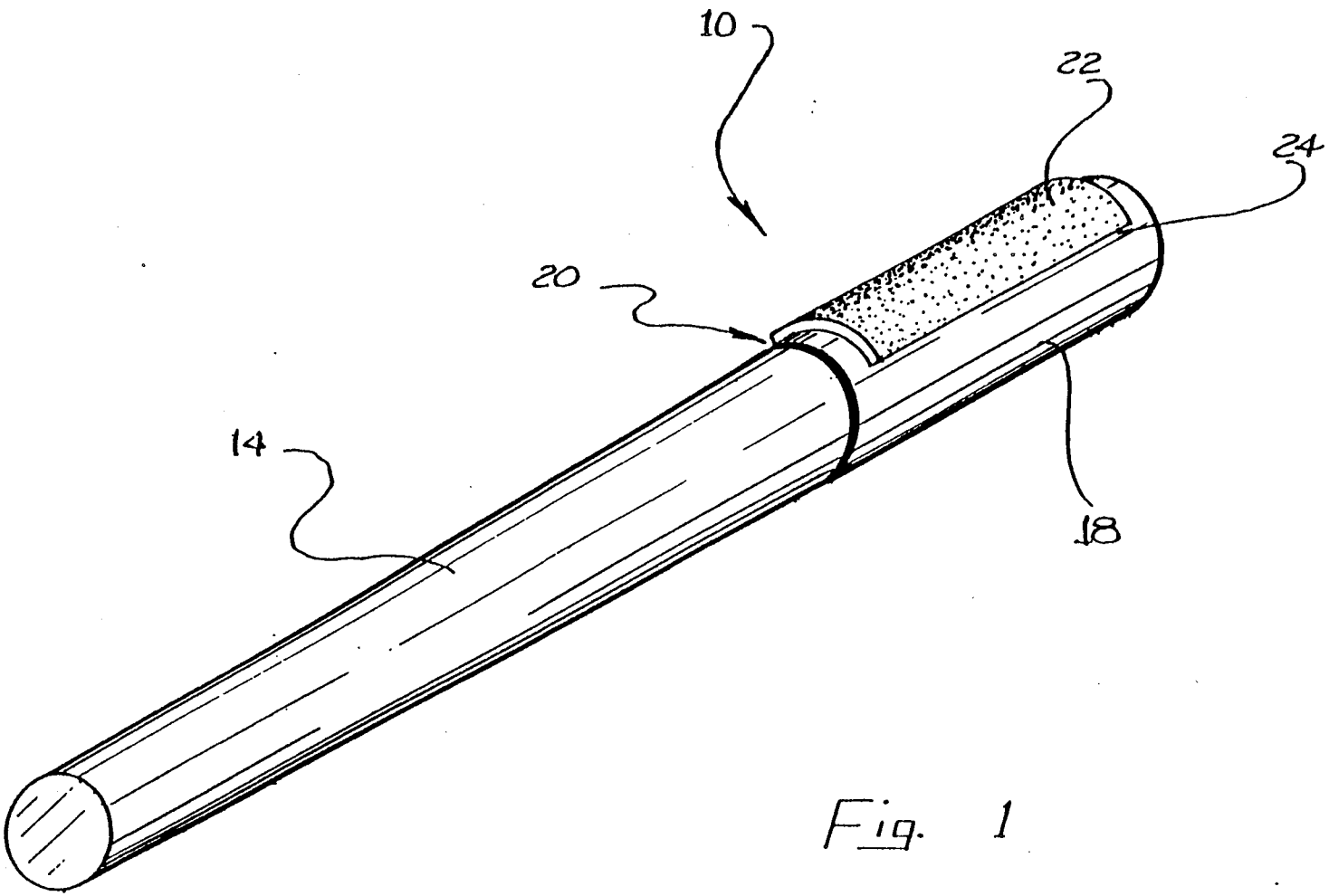
FIG. 1 is a perspective view of a first preferred embodiment of the invention.

Referring to FIG. 1, first preferred embodiment 10 consists of a body 18 having one aperture 20. Body 18 and aperture 20 are consistent with conventional cap construction. A cloth covering 22 is mounted to a portion 24 of body 18.

Writing instrument 14 are sold with caps which are intended to retard evaporation of the ink and guard against unintentional marking of surrounding surfaces. In order to use first embodiment 10, the cap which comes with writing instrument 14 is discarded and a tip 26 of writing instrument 14 is inserted in aperture 20. Writing instrument 14 is then used as a handle to permit manipulation of body 18.

Figure 2:
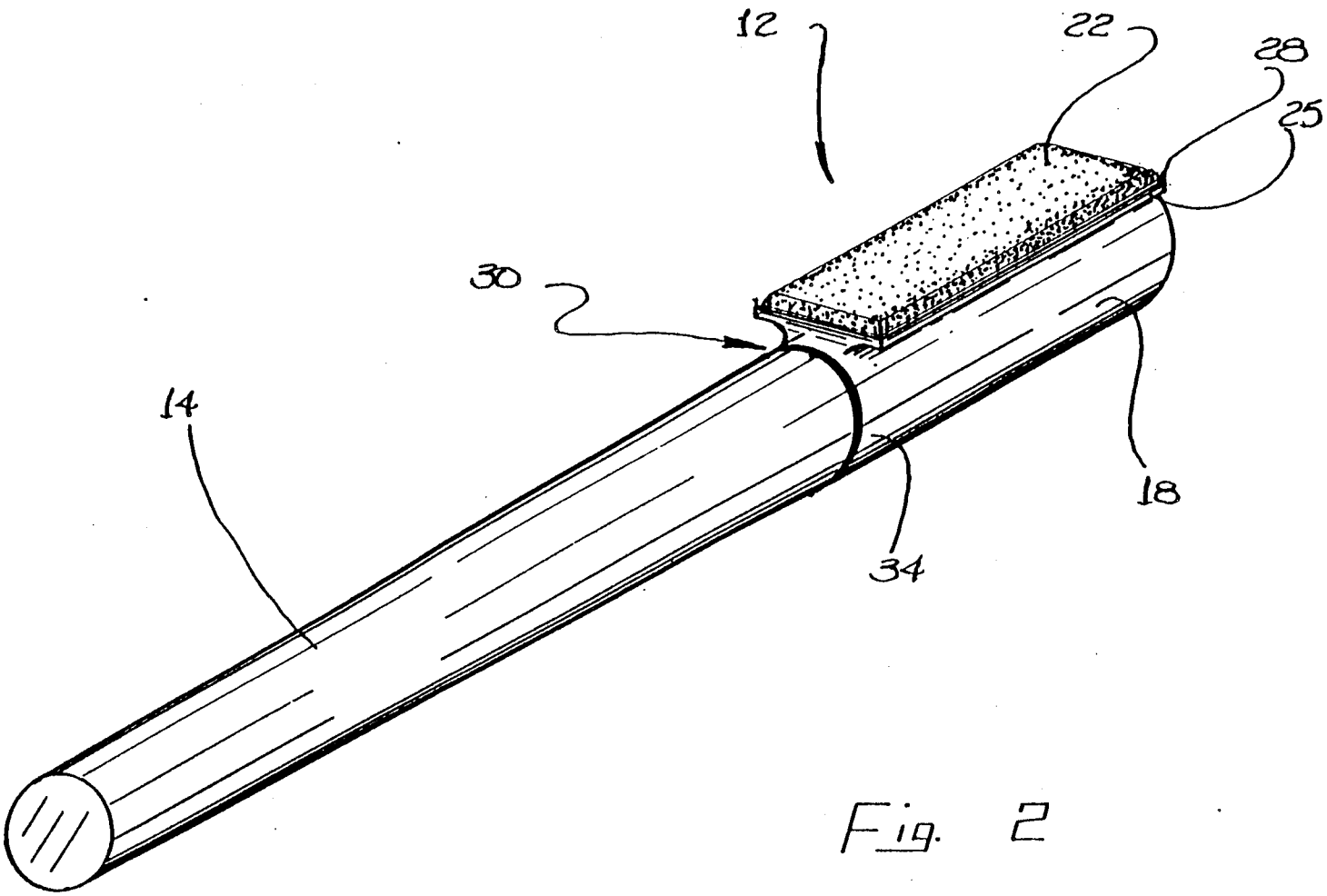
FIG. 2 is a perspective view of a second preferred embodiment of the invention.

Referring to FIG. 2, second preferred embodiment 12 consists of a body 18 which has an attached plate 25 providing a planar surface 28. Body 18 has one aperture 30. Aperture 30 is positioned at one end 34. A cloth covering 22 is mounted to planar surface 28 of body 18. Cloth covering 22 is of uncut nylon pile material.

In order to use second embodiment 12, a tip 26 of writing instrument 14 is inserted into aperture 30. Writing instrument 14 is then used as a handle to permit manipulation of body 18.

Referring to FIG. 3, third preferred embodiment 13 consists of a body 18 which has an attached plate 25 providing a planar surface 28. In this embodiment plate 25 is connected to body 18 by a finger grip portion 27 which extends perpendicularly from body 18. Body 18 has two apertures 30 and 32. Aperture 30 is positioned at one end 34. Aperture 32 is positioned at the other end 36. A cloth covering 22 is mounted to planar surface 28 of body 18. Cloth covering 22 is of uncut nylon pile material.

Third embodiment 13 can be used with or without writing instrument 14. If writing instrument 14 is used, a tip 26 of writing instrument 14 is inserted into one of apertures 30 or 32. Apertures 30 and 32 accommodate two of the more popular standard sizes of writing instruments 14. FIGS. 3 and 4 show both of the popular sizes of dry-erasable writing instruments, although in actual use only one would be employed. Writing instrument 14 is used as a handle to permit manipulation of body 18. Third embodiment 13 can also be used without writing instrument 14 by grasping finger grip portion 27.

Cloth covering 22 can be of virtually any type of material, as there are a wide variety of materials which will effectively erase whiteboard. The use of uncut nylon pile is preferred as it will mate with a tape fastener providing an additional dimension to the invention.

Referring to FIG. 5, there is illustrated the third preferred embodiment 13 used with whiteboard 16. Whiteboard 16 has a peripheral border 38. A tape fastener 40 of hook-like nylon pile is secured to peripheral border 38.

In order to use the combination illustrated in FIG. 5, covering 22 of uncut nylon pile on planar surface 28 of body 18 is placed against tape fastener 40. Tape fastener 40 matingly engages covering 22 to secure planar surface 28 of body 18 to whiteboard 16. Tape fastener 40 is, of course, placed along the peripheral border 38, as opposed to the centre, of whiteboard 16 so that it will not obstruct the use of whiteboard 16.

It should be noted that if apertures 30 and 32 of third embodiment 13 were eliminated, the existence of finger grip portion 27 would still enable the use of embodiment 13 as an eraser which can be secured to tape fastener 40 attached to whiteboard 16.

Fourth embodiment 15 was developed as a result of problems encountered in ensuring that apertures 30 and 32 retarded the evaporation of ink from writing instrument 14 as effectively as the caps which were being discarded. Fourth embodiment 15 has the same basic construction as the third embodiment. There is a body 18 which has an attached plate 25 providing a planar surface 28. A finger grip portion 27 extends perpendicularly from body 18. Body 18 has two apertures 30 and 32. Aperture 30 is positioned at one end 34. Aperture 32 is positioned at the other end 36. A cloth covering 22 is mounted to planar surface 28 of body 18. Cloth covering 22 is of uncut nylon pile material. However, apertures 30 and 32 are modified to receive a cap 17 of writing instrument 14 in friction fit engagement. Referring to FIG. 6, a plurality of ribs 19 are provided to accommodate cap 17 of one of the standard sizes of writing instrument used with whiteboards. With other models of writing instrument 14, apertures 30 and 32 need only be enlarged so all of cap 17, rather than just tip 26 of writing instrument 14, can be accommodated.

Fourth embodiment 15 is used in the same fashion as third embodiment 13.

It will be apparent to one skilled in the art that the use of any of the preferred embodiments provides the whiteboard user with the necessary equipment in one compact form. It will also be apparent to one skilled in the art that the use of the described combination permits a writing instrument, eraser and whiteboard to be kept together. It will further be apparent to one skilled in the art that modifications may be made to the preferred embodiments without departing from the spirit and scope of the invention.

The embodiments of the invention in which an exclusive property or privilege is claimed are defined as follows:

1. An eraser, comprising:

a) a body having a planar surface substantially equal to the width of the body and extending substantially the length of the body;

b) a cloth covering mounted to and covering substantially all of the planar surface of the body, the cloth covering being of uncut nylon pile thereby serving both as a medium for erasion and a means for permitting the body to be secured to an object having a mating tape fastener of hook-like nylon pile; and c) the body having opposed ends with an aperture at each end, the apertures being of different sizes thereby permitting the body to accommodate in mating engagement differing sizes of writing instruments.

* * * * *